US005172947A

United States Patent [19]

Schap

[11] Patent Number: 5,172,947

[45] Date of Patent: Dec. 22, 1992

[54] POWER STRIKER FOR SLIDING DOOR LATCH

[75] Inventor: William W. Schap, Jackson, Mich.

[73] Assignee: ITT Corporation, New York, N.Y.

[21] Appl. No.: 640,672

[22] Filed: Jan. 14, 1991

Related U.S. Application Data

[62] Division of Ser. No. 476,206, Mar. 3, 1989, Pat. No. 5,004,280.

[51] Int. Cl.[5] ..... E05B 15/02

[52] U.S. Cl. ..... 292/341.16; 292/201

[58] Field of Search ..... 292/341.16, DIG. 43, 292/201

[56] References Cited

U.S. PATENT DOCUMENTS

| | | | |
|---|---|---|---|
| 4,707,007 | 11/1987 | Inoh | 292/341.16 |
| 4,775,178 | 10/1988 | Boyko | 292/341.16 |
| 4,982,984 | 1/1991 | Yokota et al. | 292/341.16 |

*Primary Examiner*—Kenneth J. Dorner

*Assistant Examiner*—Gerald A. Anderson

*Attorney, Agent, or Firm*—Robert P. Seitter; J. Gordon Lewis

[57] ABSTRACT

A power striker for door latch employed on the sliding side door of a van type vehicle includes a power driver rotary drive member which upon rotation through 180° is operable to drive a slide member in linear movement between opposite end limits. A striker pin may be mounted directly on the slide or coupled by linkage to the slide to be located in a ready position when the slide is at one end limit and in an actuated position when the slide is at its other end limit. When in its ready position, the pin is latched to the closing door before the door reaches its fully closed position. The pin is then driven to its actuated position to power the door to its fully closed position against the resistive force exerted by the compressible door seal. The rotary to linear drive coupling develops a sinusoidally increasing door closing force during the final door closing movement and provides a positive retention of the striker pin in its ready and actuated positions.

14 Claims, 3 Drawing Sheets

POWER STRIKER FOR SLIDING DOOR LATCH

This is a divisional of co-pending application Ser. No. 07/476,206 filed on Mar. 3, 1989 now U.S. Pat. No. 5,004,280.

BACKGROUND OF THE INVENTION

The present invention is directed to a power striker for the latch of a sliding door, such as those employed on van type vehicles.

Most present day vans are provided with a sliding door which provides access to that portion of the interior of the van from one side of the van. When closed, the sliding door is seated within its door opening and a seal which extends around the periphery of the door opening is tightly compressed between a peripheral flange on the door and the vehicle body. The door is supported for movement upon the vehicle body by horizontal tracks which are curved inwardly toward the vehicle centerline near their front end. When the door is opened, this curve or inclined track section initially guides the door along an outwardly and rearwardly inclined path until the inner side of the door has been moved outwardly of the vehicle centerline a sufficient distance to clear the outer side of the vehicle so that the door may then be moved rearwardly parallel to the vehicle centerline to clear the door opening.

The conventional latching arrangement employed to latch these doors in their closed position typically employs a striker pin fixedly mounted upon the door frame at the rear edge of the door opening and a latch assembly mounted on the rear edge of the door which will interlock with the striker pin upon closure of the door. The latch assembly usually employs a pivoted latch member spring biased to an open position and so arranged that when it initially engages the stationary striker pin prior to the complete closing of the door, the final movement of the door to its fully closed position pivots the latch member into interlocking relationship with the striker. A spring biassed pawl then seats in a notch in the pivoting latch member to hold it in its interlocked position. Actuation of the door handle will disengage the pawl to release the latch.

It is well known that closing and latching such sliding doors requires a substantial amount of force. If sufficient force is not applied, the door will not latch in its closed position. There are two reasons why this is so. First, the door seal which extends continuously around the periphery of the opening must be tightly compressed when the door is closed in order to perform its intended function. Thus, the seal exerts a progressively increasing resistance to closing movement of the door as the door approaches its fully closed position. Second, the inter engagement between the latch and striker pin must positively hold the door in its fully closed position, thus it is normally necessary for the door to move at least slightly beyond its fully closed position before the latch member can shift into fully interlocked relationship with the stationary striker pin.

The closure problem set forth above is of special concern where a power drive arrangement for opening and closing the door is employed. When the door is closed manually, the person closing the door is in a position to check to see if the door is in fact firmly latched. Power operated closures typically have their greatest convenience when the door can be opened and closed by a switch or control located adjacent the drivers seat, and from this location it is not possible to manually confirm the door is fully latched.

In that the basic root of the closure problem is the stationary striker pin which requires that the door be at least in its fully closed position before the latch can be engaged, the possibility of employing a movable striker arrangement, such as those employed in automatic trunk closing mechanisms is suggested. In the automatic trunk closing mechanism, the striker is power driven to an elevated ready position when the trunk lid is open. Upon closure of the trunk lid, the latch mechanism is first interlocked or latched to the striker while the striker is in its elevated ready position. An electric motor is then energized to drive a nut and lead screw coupling to draw the striker and latched trunk lid downwardly until the lid is in its fully closed position.

While a movable striker driven by a power driven screw is well adapted for a trunk lid closure, there are several reasons why this arrangement is not practical for use as a sliding door closure.

These reasons include the fact that a substantial portion of the power applied to a screw drive is needed to overcome the frictional resistance inherent in the system. Also the placement of the switch which activates the drive is critical in that the drive begins to move at full speed immediately. The screw drive experts a constant power throughout its full range of movement and backloads the drive motor at the end range of movement.

The drive of the present invention has substantially less friction to overcome, driver at a sinusoidable variable velocity and power, and does not backload the motor at its end limits of movement.

SUMMARY OF THE INVENTION

In accordance with the present invention, a movable striker pin is driven in movement between a ready position and a closed position by mechanism which will positively resist movement of the striker pin from either position in the absence of energization of the electrical power drive employed to shift the pin. Four exemplary mechanisms are disclosed, all having the common feature of a drive member which upon being rotated through 180° will drive the striker from its ready position to its closed position. The drive mechanism includes a slide driven by the rotary drive member in linear movement along a path normal to the axis of rotation of the rotary drive member, the slide being coupled to the drive member by mechanism which transmits to the slide only that component of the rotary motion of the drive member which is parallel to the linear path of movement of the slide. For a constant speed of rotation of the drive member, the linear speed of the slide will vary sinusoidally with the rotational position of the drive member, the slide velocity being zero at each end of its stoke and a maximum at the midpoint of its stroke. Conversely, the force transmitted to the slide is a maximum at each end of its stroke and decreases to a minimum force at the midpoint of the stroke. At each end of the stroke, the point on the slide which is coupled to the drive member and the axis of rotation of the drive member lie on a straight line which is parallel to the linear path of movement of the slide. Thus, a force tending to displace the slide from one of its end limit positions toward the other acts along a line which would pass through the center of rotation of the rotary drive and provide a positive resistance to such movement.

In one form of the invention, a U-shaped link is pivotal coupled at one end to the rotary drive member at a location displaced from the axis of rotation of the member and is pivotally coupled at its opposite end to the slide. When the slide is at one end limit of movement, the pivot axis on the U-shaped link and the axis of rotation of the drive member lie on a common straight line with both pivots of the U-shaped link lying at one side of the axis of rotation of the drive. Upon rotation of the drive member through 180°, the pivotal connection between the drive member and U-shaped link is moved to the opposite side of the axis of rotation of the drive, the legs of the U-shaped link straddling the drive shaft when the 180° rotation is completed.

In another embodiment of the invention, a circular cam is mounted upon the rotary drive shaft in eccentric relationship to the drive shaft axis. With a drive shaft at a rest position, the high point and low point of the eccentric cam lie on a line passing through the drive shaft axis, which line is parallel to the linear path movement of the slide. The slide is formed with two abutment shoulders which intentionally engage the cam periphery at diametrically opposed locations. When the slide is at either end limit, the diametrically opposed points on the cam engaged by the abutments on the slide are the high point and low point of eccentricity.

In another form of mechanism, the rotary drive member is formed with a semi circular slot eccentrically disposed with respect to the axis of rotation of the drive member. A roller on the slide is received within this slot.

The space available for mounting the slide and associated drive mechanism in the door frame normally is quite confined, and varies in configuration between different makes and vehicle models. In some cases, the space available may enable the mounting of the striker pin directly upon the slide, while in other cases space for the drive member and associated mechanism may not be available immediately adjacent the slide. In these latter cases, the slide which is driven directly by the drive member may be coupled by a link to a second slide member which carries the striker pin so that the drive mechanism, which is coupled directly to the drive motor, need not be located closely adjacent the pin carrying slide.

Other objects and features of the invention will become apparent by reference to the following specification and to the drawings.

IN THE DRAWINGS

Figure 1:
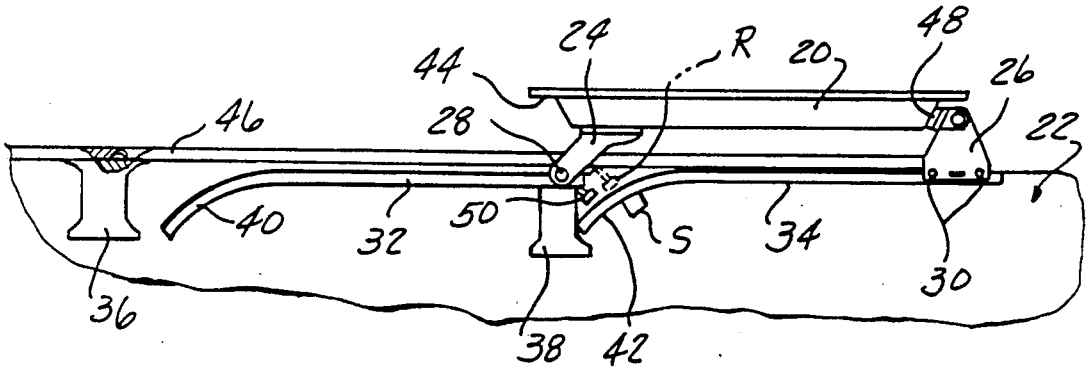
FIG. 1 is a schematic diagram of a typical sliding door arrangement for a van.

FIG. 1 is a schematic diagram intended to show the general arrangement of a sliding door for a van. The diagram is essentially a top upper plan view with many elements omitted. As viewed from above, the sliding door 20 is supported upon the vehicle frame designated generally 22 by forward travelers, one of which is indicated at 24 and a rear traveler 26 each of which carries track engaging rollers such as 28 and 30. The roller 28 of the forward traveler 30 is received within a first roller track 32 fixedly mounted on the vehicle frame, while the rollers 30 of the rear traveler are received in a roller track 34 which is recessed into the outer side of the van body. Typically, two forward travelers 24 are employed, one mounted near the top of the door and the other at its bottom, with the roller 28 of the bottom traveler being received in a track 32 mounted in the vehicle floor and the roller of the upper traveler 24 being received within a track extending along the under side of the roof of the vehicle. A single rear traveler 26 is conventionally mounted about midway between the top and bottom of the door.

In FIG. 1, the door 20 is shown in its open position in which the door is located in adjacent outwardly spaced parallel relationship to the outer side of the vehicle body rearwardly of the door opening which is located between front and rear door frame members 36 and 38 respectively. To close the door, the door is slid forwardly (to the left as viewed in FIG. 1). The tracks 32 and 34 guide their respective travelers to cause the door to move parallel to the side of the vehicle in outwardly spaced relationship to the vehicle side until the traveler rollers move onto inwardly inclined sections 40 and 42 near the front ends of the respective tracks 32 and 34. As the traveler rollers move onto these sections of the track, the door begins to move inwardly of the side of the vehicle until, when the traveler rollers reach the forward ends of their respective tracks, the door is seated within the door opening with its outer side flush with the outer side of the vehicle. When in this closed position, an inwardly facing flange 44 which extends around the periphery of the door is seated against a resilient seal 46 which is mounted on the vehicle body to extend around the entire periphery of door opening. The door is latched in its closed position by the inter locking of a latch assembly designated generally 48 mounted on the rear edge of door 20 with a striker pin 50 fixedly mounted upon and projecting from the rear door frame 38. A typical latch assembly is schematically shown in FIGS. 2 and 3.

Figure 2:
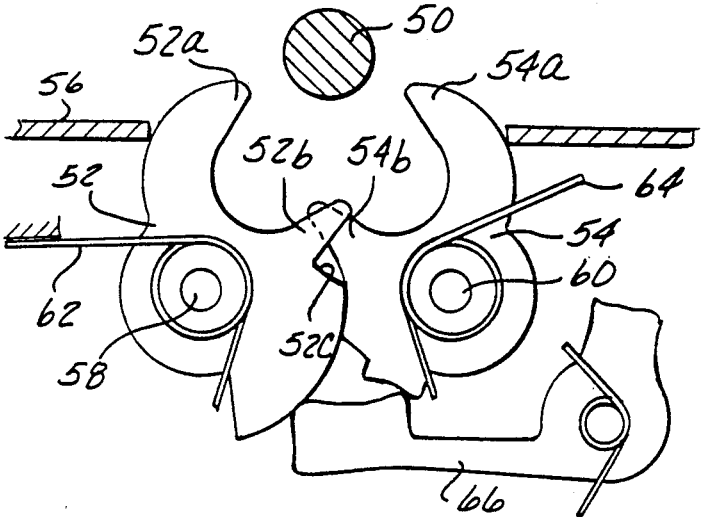
FIG. 2 is a schematic diagram of a typical door latch assembly employed on the van door of FIG. 1, showing the latch assembly in its open position.
Figure 3:
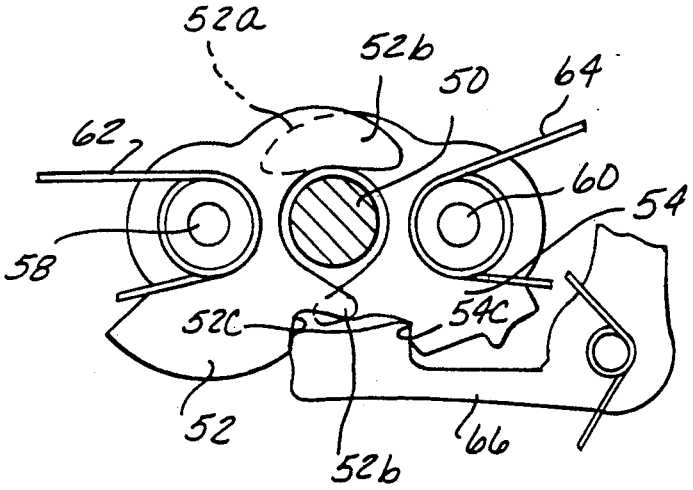
FIG. 3 is a schematic view of the latch assembly of FIG. 2 showing the latch in its closed position.

Referring now particularly to FIGS. 2 and 3, a simplified schematic diagram of a known form of latch assembly is shown as including a pair of latch members 52, 54 mounted within a housing 56 for pivotal movement about spaced parallel pivot axes defined by pivot pins 58, 60. Torsion springs 62, 64 engaged between housing 56 and the respective latch members 52, 54 bias the latch members to the open position shown in FIG. 2.

Each of latch members 52 and 54 is formed with a U-shaped recess defined between projecting arms 52*a*, 52*b* of member 52 and 54*a*, 54*b* of member 54. When the latch assembly is in its open position shown in FIG. 2, the arms 52*a*, 54*a* of the respective latch members are spaced apart from each other, while the other arms 52*b* and 54*b* are in overlapping relationship, the members 52 and 54 being axially offset from each other to provide the necessary clearance for non interference. The spacing between the arms 52*a* and 54*a* is such that as the door carrying the latch assembly moves forwardly toward its closed position, the arms 52*a* and 54*a* may move freely past the opposite sides of the stationary striker pin 50. As the latch assembly continues to move forward, the pin engages the overlapped ends of arms 52*b*, 54*b*, and continued forward movement of the latch assembly toward the striker pin enables the pin to pivot both latch members about their axes against the action of the torsion spring 62, 64 to swing the opposed arms 52*a*, 54*a* inwardly behind the striker pin to the latched position shown in FIG. 3. In this position, a spring biassed pawl 66 snaps into position between abutment surfaces 52*c*, 54*c* on the respective latch members to positively retain the latch members in the latching position shown in FIG. 3 in which the striker pin is firmly clasped between the latch members. Operation of the conventional door handle will withdrawal pawl 66 from between abutments 52*c*, 54*c* to permit members 52, 54 to swing back to their open position, the biassing force exerted by torsion springs 62, 64 being sufficient to move the door carrying the latch assembly the slight distance necessary to accommodate the opening movement of members 52 and 54.

The structure described thus far is completely conventional, but presents certain problems which the present invention overcomes. During the final portion of the movement of the door 20 to its fully closed position, the door encounters increasing resistance to closing movement from two sources. The first of these resisting forces is that required to compress the peripheral door seal 46, the second is the force required to overcome the biassing action of the springs 62, 64 which bias the latch members to their open position, it being necessary to overcome this latter force to latch the door in its closed position.

Of these two forces, the resistive force exerted by the resilient door seal is by far the greater. Both forces progressively increase as the door moves through the final portion of its movement toward the closed position, and in order to lock the latch, the door must move slightly beyond its fully closed position so the latch pawl can seat. In order to perform its function, the door seal 46 must firmly and tightly engage the inner side of the door flange in order to maintain this seal in the face of vibration and road shock. The dimensions of the door opening are such that the length of the seal is substantial and this, combined with the fact that a fairly substantial pressure must be applied to maintain the seal results in a relatively large force resisting the final phase of the door closing movement.

The present invention overcomes this problem by mounting the striker pin for movement which enables the pin to be initially located in a ready position at which the latch may be latched to the striker pin before any substantial resistance is encountered from the seal and then, once the latch is engaged, driving the striker pin to a closed position by a mechanism sufficiently powerful to overcome the compressive resistance of the seal.

Figure 4:
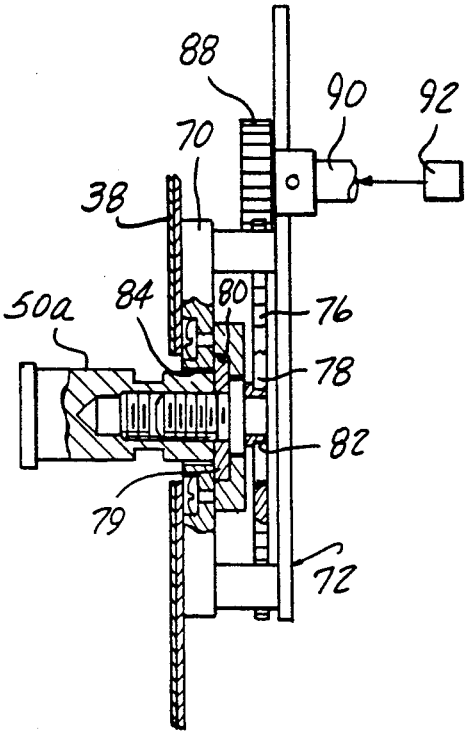
FIG. 4 is a side view, with certain parts broken away, shown in section or schematically, of one form of striker pin assembly embodying the present invention.
Figure 5:
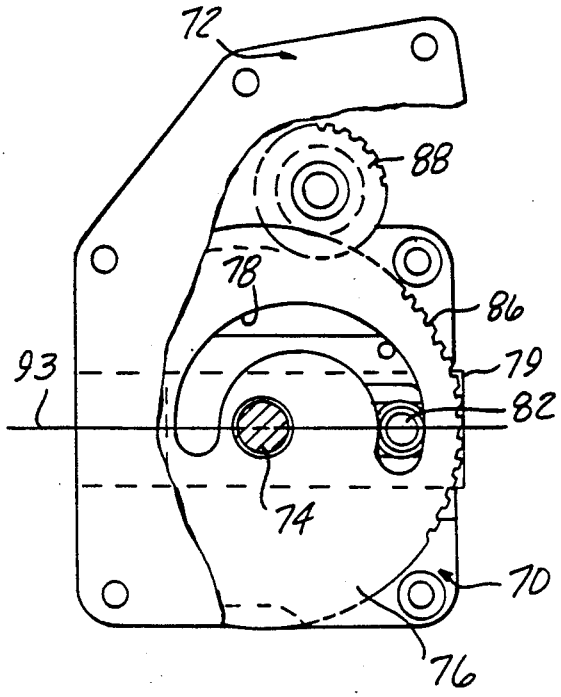
FIG. 5 is a rear view of the striker pin assembly of FIG. 4, with certain parts broken away or omitted.

A first form of such mechanism is shown in FIGS. 4 and 5.

Referring first to FIG. 4, a powered striker pin assembly includes a base plate 70 which may be fixedly mounted at an appropriate location upon door frame 38. A mounting bracket designated generally 72 is fixedly mounted upon base plate 70 and, as best seen in FIG. 5, carries a stub shaft 74 which rotatably supports a rotatable cam plate 76. Cam plate 76 is formed with a semi circular slot 78 which is centered about an axis offset from that of stub shaft 74. A slide plate 79 is mounted for sliding movement within a slot 80 (FIG. 4) formed on bracket 72, the slot 80 restricting the slide 79 to movement from left to right or vice versa as viewed in FIG. 5. A roller 82 rotatably mounted on slide 79 is received within slot 78 of cam 76. A striker pin 50*a* is fixedly mounted on slide 79 for movement with the slide along a slot 84 (FIG. 4) in bracket 70. Gear teeth 86 formed on the periphery of cam 76 mesh with a drive pinion 88 mounted upon the drive shaft 90 of a schematically illustrated drive motor 92.

Referring now particularly to FIG. 5, the mechanism is shown at one end limit of movement at which the axis of rotation of cam 76 defined by stub shaft 74 and the points of engagement between roller 82 and the walls of slot 78 lie on a straight line 93 which extends parallel to the path of movement of slide 79. The semi circular slot 78 is eccentric to the axis of stub shaft 74 and, in the position shown in FIG. 5, roller 82 engages slot 78 at the high point of the eccentricity. The slide 79 is thus located at one end limit of its movement relative to the fixed frame of the mechanism constituted by base plate 70 and bracket 72. Upon actuation of drive motor 92 to rotate pinion 88 in a direction driving cam 76 in clockwise rotation about stub shaft 74 as viewed in FIG. 5, the eccentric slot 78 will cause roller 82, and hence slide 79 to move to the left in response to this clockwise rotation of cam 76. When a rotation of 180° is completed, roller 82 will be engaged with that portion of slot 78 which lies at a minimum distance from the axis of stub shaft 74 and slide 79 will be located at its extreme lefthand end limit of movement relative to bracket 72. In that striker pin 50*a* is in turn fixedly mounted upon slide 79, this 180° rotation of cam 76 will cause striker pin 50*a* to move in linear movement with slide 78. Rotation of cam 76 through an angle of 180° in a counter clockwise direction will return slide 79, and hence striker 50*a* to its original position.

The mechanism shown in FIGS. 4 and 5 is mounted in door frame 38 so that the path of movement of slide 79 extends parallel to the inclined end section 42 (FIG. 1) of the rear guide roller 34 with its striker 50*a* projecting into the path of movement of the door carried latch assembly 48.

As described above, the striker pin 50 as shown in FIG. 1 in a conventional assembly is a stationary pin and is shown in FIG. 1 so located as to hold the door 20 in its fully closed position when the latch assembly 48 on the door is engaged with the pin 50.

The striker pin mechanism of FIGS. 4 and 5 permits a powered movement of its pin 50*a* along a path parallel to that followed by movement of the door to and from its closed position. This range of movement is such that when the pin 50*a* is at one end limit of its movement, it would be located at the position of the stationary striker pin 50 in FIG. 1 and would be located in a ready position R indicated in broken line in FIG. 1 when at its opposite end limit of movement. When located in the ready position R of FIG. 1, upon closing of the door 20, the latch 48 will engage and latch to the striker pin at position R before the seal engaging flange 44 of door 20 is required to exert any substantial compressive force upon resident seal 46. With the door now latched to the striker pin, drive motor 92 (FIG. 4) is actuated to drive cam 76 through a 180° rotation to shift the striker pin (returning now to FIG. 1) from position R to that location in FIG. 1 occupied by striker pin 50. Because the door 20 is latched to the striker pin during this movement, the pin drives the latched door to its fully closed position, the driving force developed by the pin being more than sufficient to overcome the compressive resisting force exerted against the door by the compressing seal 46. Actuation of motor 92 may be initiated by a suitably located door position detector switch such as schematically illustrated at S in FIG. 1.

Upon a subsequent opening of the door, the door is manually unlatched from the striker pin and upon rearward movement of the door past switch S, switch S will, through an appropriate control circuit, actuate motor 92 to drive in a reverse direction to cause the mechanism of FIGS. 4 and 5 to return the striker pin to position R.

Figure 6:
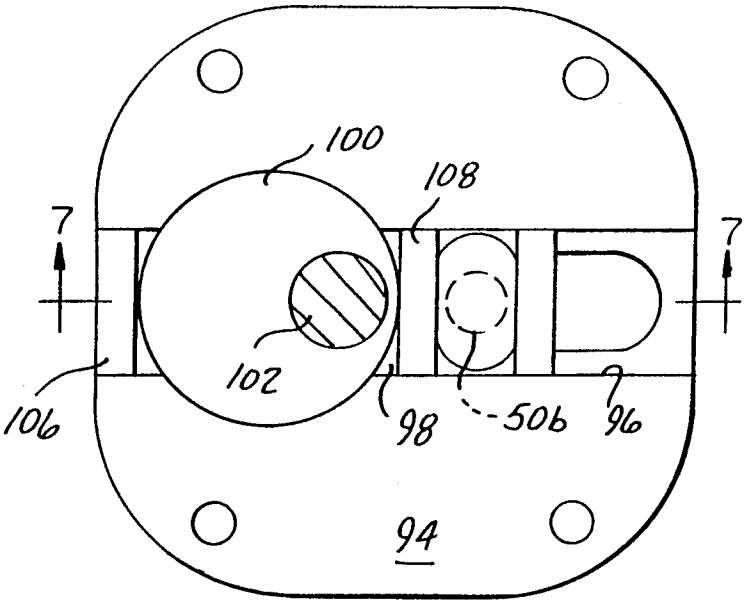
FIG. 6 is a rear view of another form of striker pin assembly.
Figure 7:
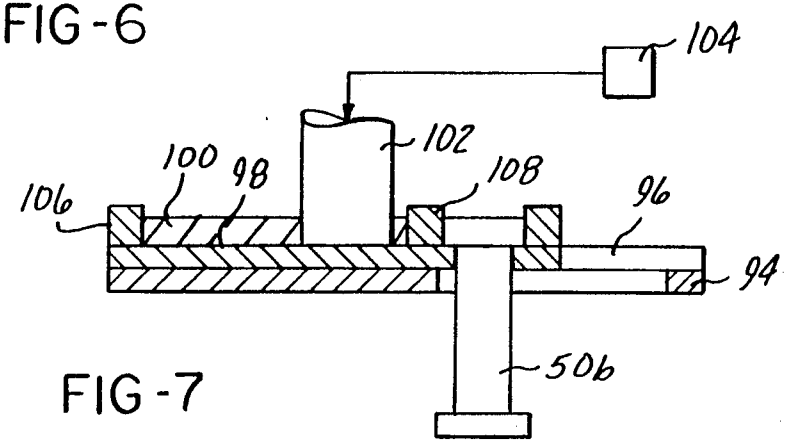
FIG. 7 is a cross sectional view of the assembly of FIG. 6 taken on the line 7—7 of FIG. 6.

An alternative form of mechanism is shown in FIGS. 6 and 7. In the embodiment of FIGS. 6 and 7, a base plate 94 is formed with a slide way 96 which slidably receives a slide 98. A circular cam 100 is eccentrically mounted upon the drive shaft 102 of a drive motor schematically indicated at 104 for rotation in substantial face to face engagement with one side of plate 94. A pair of abutment shoulders 106, 108 project from slide 98 to tangentially engage the periphery of eccentric 100 at diametrically opposed locations. A striker pin **50*b* is fixedly secured to slide 98 to project through a slot in mounting plate 94**.

In FIG. 6, cam 100 is shown in one of its two rest positions in which the axis of rotation of its drive shaft 102 and the tangential points of contact between the cam and abutments 106, 108 of the slide all lie on a straight line 112 parallel to the path of movement of slide 98, with abutment 106 engaged with the high point of eccentricity and abutment 108 engaged with the low point of eccentricity. Slide 98, as shown in FIG. 6, is at its extreme lefthand end limit of movement relative to mounting plate 94. Upon rotation of cam 100 in a clockwise direction through 180°, slide 98 will be driven to the right from the FIG. 6 position, and at the conclusion of this movement, the high point of eccentricity of cam 100 will be tangentially engaged by abutment 108, while the low point will be engaged by abutment 106.

Figure 8:
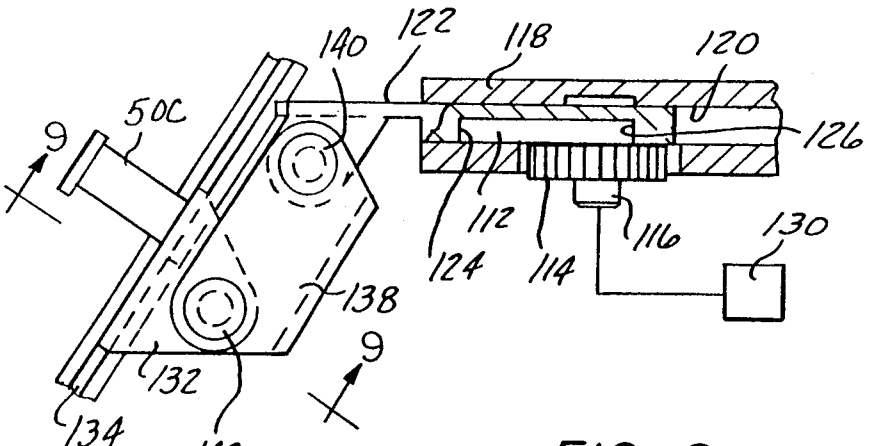
FIG. 8 is a top view of a third form of striker assembly, with certain parts shown in section, broken away, or shown schematically.
Figure 9:
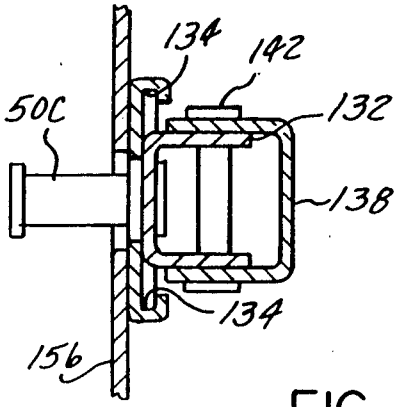
FIG. 9 is a detail cross sectional view of the assembly of FIG. 8 taken on the line 9—9 of FIG. 8.

A third form of mechanism is shown in FIGS. 8 and 9 this particular arrangement being adapted for use in situations where the vehicle frame configuration will not accommodate the mounting of the drive mechanism and motor closely adjacent the striker pin carrying slide.

The embodiment of FIGS. 8 and 9 employs a circular cam 112 eccentrically mounted upon a drive pinion 114 mounted for rotation about a fixed shaft 116 mounted upon a housing 118.

Housing 118 is formed with a guide slot 120 which slidably receives a first slide member 122 formed with opposed abutment shoulders 124, 126 which engage the eccentric cam 112 in the same manner that shoulders 106 and 108 engage the eccentric cam 100 in the embodiment of FIG. 6. Slide 122 may be formed with a slot 128 to accommodate movement of the slide relative to the fixed shaft 116. Pinion 114 is drivingly coupled to a schematically illustrated drive motor 130.

The striker pin **50*c* of the embodiment of FIGS. 8 and 9 is mounted upon a base member 132 which is in turn mounted for guidance sliding movement within a slot 134 formed on a fixed frame member 136. A link 138 is pivotally connected at one end by a pivot 140 to slide 122 and is pivotally connected at its opposite end by a pivot 142 to base 132. Movement of slide 122 from left to right as viewed in FIG. 8 by rotation of the eccentric 112 is transmitted by link 138 to base 132 to cause a corresponding movement of pin 50*c* upwardly and to the right along the slot 134**.

Figure 10:
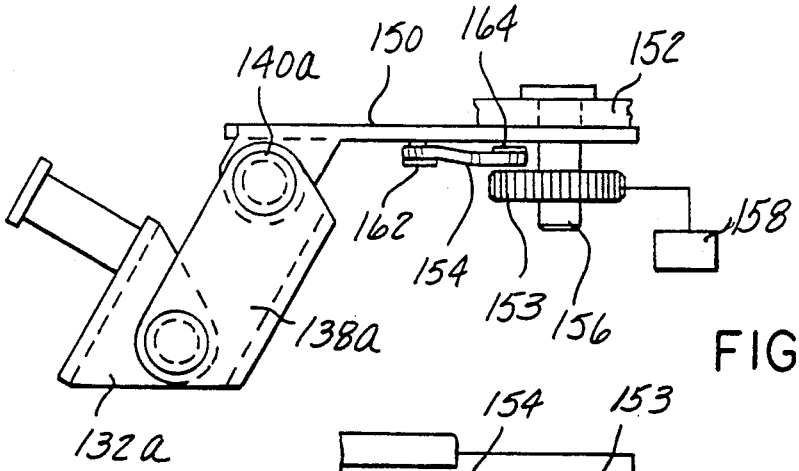
FIG. 10 is a top plan view of another form of striker pin assembly embodying the present invention.
Figure 11:
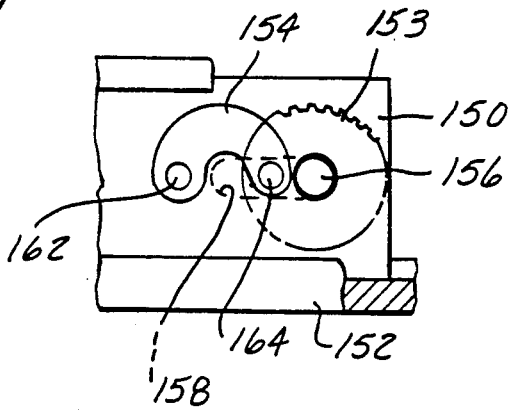
FIG. 11 is a rear view of a portion of the assembly of FIG. 10.

A fourth form of mechanism is shown in FIGS. 10 and 11 which employs a pin mounting base **132*a* and link 138*a* arrangement similar to that employed in the embodiment of FIGS. 8 and 9, reference numerals with the subscript a being employed to identify corresponding parts as between these two embodiments. A slide 150 is mounted for sliding movement in suitably slotted frame members, such as 152 and is pivotally coupled at one end by pivot 140*a* to link 138*a*. A drive pinion 153 is mounted for rotation about a fixed shaft 156 projecting through a slot 158 in slide 150 and is coupled to slide 150 by a U-shaped link 154 having one leg coupled to slide 150 by pivot 162 and its opposite leg pivotally coupled by a pivot 164 to pinion 153 at a location offset from the axis of shaft 156**.

In FIG. 11, slide 150 is shown at its lefthand end limit of movement, the axis of pivots 162 and 164 lying on a straight line which also passes through the axis of shaft 156 and extends parallel to the path of movement of slide 150. Upon actuation of drive motor 160 to drive pinion 153 180° in a clockwise direction from the position shown in FIG. 11, the pivot 164 will be carried by pinion 153 upwardly over shaft 156 and then downwardly on the opposite side of the shaft. At the completion of the 180° rotation, the pivots 162, 164 will be disposed on opposite sides of shaft 156 with the axis of the pivots and shaft 156 again lying on a straight line parallel to the path of slide movement. This movement of slide 150 is transmitted by link **138*a* to striker pin 50*d* as in the embodiment of FIGS. 8 and 9**.

In all four embodiments described above, a 180° rotation of a pin or eccentric cam surface about a fixed axis is transformed into linear movement of a slide member from one end limit to another. For a constant speed of rotation of the rotary drive element, the linear velocity of movement of the slide will vary sinusoidally with the angular displacement of the rotary member from its start position. In terms of velocity, this means that the slide will move from its start position with a slow but increasing velocity, will reach a maximum velocity at the midpoint of its travel and then slow to come to a dead stop as the drive member arrives at 180° from its start position. This enables the drive motor to start to drive the striker pin from its ready position as soon as or even before the pin is initially engaged with the latch assembly of the closing door.

More importantly, however, the force transmitted to the slide member by the rotary drive member also varies sinusoidally in accordance with the rotary position of the drive member to be a maximum at the beginning and, more importantly, at the ending of the stroke of the slide member. This is an important feature in that the slide member transmits to the striker pin a driving force which sinusoidally increases as the pin moves the door in its final phase of movement to its fully closed position, at which time the increasing compression of the door seal increasingly resists closing movement of the door.

Further, when the striker pin is at the fully door closed position, the forces urging the pin away from this position act along a line which passes through the axis of rotation of the drive member and thus the geometry of the mechanisms described above is such that the slide is positively retained at each end limit of movement, thus imposing a similar constraint upon the striker pin.

While various embodiments of the invention have been described in detail, it will be apparent to those skilled in the art the disclosed embodiments may be modified. Therefore, the foregoing description is to be considered exemplary, rather than limiting, and the true scope of the invention is that defined in the following claims:

I claim:

1. In a sliding door assembly including a fixed frame defining a door opening, a door mounted on said frame for sliding movement along a fixed door path between a first end limit wherein said door is located in a closed position closing said opening and a second end limit wherein said door is in an open position, a striker pin mounted on said fixed frame, and latch means mounted on said door engageable with said striker pin for releasably latching said door in said closed position, said latch means being operable during movement of said door toward said closed position to interlock with said striker pin to releasably latch said door against movement relative to said striker pin;

the improvement comprising means mounting said striker pin for movement relative to said frame along a fixed pin path between a ready position and an actuated position, said pin when in said ready position being engageable by said latch means upon closing movement of said door to an approach position spaced from its closed position and being operable when in said actuated position to latch said door in its closed position, and means for driving said pin between said ready and closed positions comprising a first slide member mounted on said frame for sliding movement along a first fixed linear slide path, a second slide member carrying said striker pin for displacement along a second fixed linear slide path angularly offset from said first slide path, means interconnecting said slide members to effect synchronized displacement therebetween, a drive member mounted for rotation about a fixed axis normal to said first slide path, first coupling means coupling said drive member to said first slide member for transmitting that component of rotary motion of said first drive member which is parallel to said first slide path to said first slide member to move said first slide member along said first slide path between a first and a second rest position in response to a 180 degree rotation of said drive member about said axis, second coupling means coupling said pin to said second slide member for locating said pin in said ready position when said first slide member is in said first rest position and for locating said pin in said actuated position when said first slide member is in said second rest position, and actuating means operable in response to closing movement of said door past said approach position for rotating said drive member to drive said first slide member from said first rest position to said second rest position and operable in response to opening movement of said door past said approach position to rotate said drive member to drive said first slide member from said second position to said first position.

2. The invention defined in claim 1 wherein said second coupling means comprises means fixedly mounting said pin upon said second slide member with said pin projecting from said second slide member in perpendicular relationship to said second slide path.

3. The invention defined in claim 2 wherein said first coupling means comprises cam means concentric with a second axis located in spaced parallel relationship to said fixed axis, and cam follower means on said first slide member slidably engaged with said cam means.

4. The invention defined in claim 3 wherein said fixed axis, said second axis and the point of engagement between said follower means and said cam means all lie upon a straight line parallel to said first slide path when said first slide member is in either of its first and second rest positions.

5. The invention defined in claim 3 wherein said cam means comprises means defining a semi circular slot in said drive member concentric with said second axis, and said follower means comprises a roller mounted on said first slide member and projecting into said slot.

6. The invention defined in claim 3 wherein said cam means comprises a cam having a circular peripheral cam surface concentric with said second axis and said follower means comprises a pair of spaced abutment surfaces on said first slide member tangentially engaging said cam surface at diametrically opposed locations on said cam surface.

7. A striker assembly comprising a base plate for mounting said striker assembly to a doorframe, a first slide member associated with said base plate for linear movement relative thereto, said first slide member being movable along a first fixed linear slide path between first and second end limits of travel, a second slide member adapted for displacement adjacent said door frame along a second fixed linear slide path angularly offset from said first slide path, means interconnecting said slide members to effect synchronized displacement therebetween, one face of said second slide member having a striker pin extending therefrom whereby said striker pin moves linearly between first and second positions associated with vehicle door open and closed conditions, a drive member mounted for rotation about a fixed axis normal to said first slide path, first coupling means coupling said drive member to said first slide member for transmitting that component of rotary motion of said drive member which is parallel to said first slide path to said first slide member to move said first slide member along said first slide path between its first and second end limits of travel in response to a 180 degree rotation of said drive member about said axis.

8. A striker assembly in accordance with claim 7 wherein said first coupling means comprises cam means concentric with a second axis located in spaced parallel relationship to said fixed axis, and cam follower means on said first slide member slidably engaged with said cam means.

9. A striker assembly in accordance with claim 8 wherein said cam means comprises means defining a semi circular slot in said drive member concentric with said second axis, and said follower means comprises a roller mounted on said first slide member and projecting into said slot.

10. A striker assembly in accordance with claim 8 wherein said cam means comprises a cam having a circular peripheral cam surface concentric with said second axis and said follower means comprises a pair of spaced abutment surfaces on said first slide member tangentially engaging said cam surface at diametrically opposed locations on said cam.

11. A striker assembly in accordance with claim 7 wherein said first coupling means comprises a circular cam mounted for eccentric rotation about said fixed axis, and a pair of spaced abutment surfaces on said first slide member tangentially engaged with the periphery of said cam at diametrically opposed positions.

12. A striker assembly in accordance with claim 7 wherein said first coupling means comprises a link pivotally coupled at one end to said drive member and pivotally coupled at its opposite end to said first slide member.

13. A striker assembly in accordance with claim 12 wherein said fixed axis and the pivotal connections between said link and said drive member and first slide member all lie on a straight line parallel to said first slide path when said first slide member is in either of its first and second end limits of travel.

14. A striker assembly comprising a base plate for mounting said striker assembly to a doorframe, a first slide member associated with said base plate for linear movement relative thereto, said first slide member being movable along a first fixed linear slide path between first and second end limits of travel, a second slide member adapted for displacement adjacent said door frame along a second fixed linear slide path angularly offset from said first slide path, means interconnecting said slide members to effect synchronized displacement therebetween, one face of said second slide member having a striker pin extending therefrom whereby said striker pin moves linearly between first and second positions associated with vehicle door open and closed conditions, a drive member mounted for rotation about a fixed axis normal to said first slide path, first coupling means coupling said drive member to said first slide member for transmitting that component of rotary motion of said drive member which is parallel to said first slide path to said first slide member to move said first slide member along said first slide path between its first and second end limits of travel in response to a 180 degree rotation of said drive member about said axis, wherein said first coupling means comprises cam means concentric with a second axis located in spaced parallel relationship to said fixed axis, and cam follower means on said slide member slidably engaged with said cam means, and wherein said fixed axis, said second axis and the point of engagement between said follower means and said cam means all lie upon a straight line parallel to said slide path when said slide member is in either of its first and second rest positions.

* * * * *